United States Patent [19]

Cale

[11] 4,015,697

[45] Apr. 5, 1977

[54] RAILWAY CAR BRAKE RIGGING LINKAGE

[75] Inventor: Roland E. Cale, Cortland, Ohio

[73] Assignee: Schaefer Equipment Company, Warren, Ohio

[22] Filed: Oct. 14, 1975

[21] Appl. No.: 622,373

[52] U.S. Cl. ..... 188/209

[51] Int. Cl.[2] ..... F16D 65/14

[58] Field of Search ..... 188/209, 207, 206 R, 188/52–55, 219.1, 219.6

[56] References Cited

UNITED STATES PATENTS

| | | | |
|---|---|---|---|
| 1,903,997 | 4/1933 | Hankins | 188/206 R |
| 3,423,112 | 1/1969 | Cale | 188/209 X |
| 3,442,358 | 5/1969 | Mersereau | 188/52 X |
| 3,917,025 | 11/1975 | Yates et al. | 188/52 |

*Primary Examiner*—Trygve M. Blix
*Assistant Examiner*—Douglas C. Butler
*Attorney, Agent, or Firm*—Brown, Murray, Flick & Peckham

[57] ABSTRACT

A link is provided at one end with a first opening for receiving a member supported by a railway car body, and at the opposite end with a second opening. Extending through the second opening is a clevis that has parallel free ends provided with aligned openings for connecting it to the upper end of a brake beam lever. The shape of the second opening and the portion of the clevis in it is such that the clevis is restrained by the link from swinging relative to the link in a plane perpendicular to the axis of the clevis opening. The supporting member for the opposite end of the link has a hook extending through the first opening. The link may be made short enough to be located substantially horizontally between the dead lever and the adjacent axle.

4 Claims, 7 Drawing Figures

RAILWAY CAR BRAKE RIGGING LINKAGE

In a common form of railway car brake rigging the brake rod that actuates the brakes is connected to the upper end of the live brake beam lever, and the lower ends of the live and dead levers are connected by a connecting rod or bottom rod. The upper end of the dead lever is anchored to the car by connecting the dead lever by means of a dead lever rod to a point on the bottom of the car. Pivot pins are used at both ends of the dead lever rod. This rod is inclined upwardly from the dead lever to the car and crosses one of the truck axles. This inclination of the dead lever rod is undesirable, but to make it horizontal, it would have to be short enough to fit between the dead lever and the adjacent axle. The actuating brake rod that is pinned to the upper end of the live lever and the lower end of the vertical actuating or fulcrum lever is inclined upwardly across the other axle, which likewise is undesirable.

It is among the objects of this invention to provide in railway car brake rigging, linkage for anchoring the upper end of the dead lever, which can be mounted between the dead lever and the adjacent axle, which is flexible enough to present no problem in installation, in which a connecting link can be substantially horizontal. Other objects are to provide linkage for connecting the upper end of the live brake lever with the lower end of the actuating lever, which can extend substantially horizontally across the underlying axle.

The invention is illustrated in the accompanying drawings, in which

Figure 1:
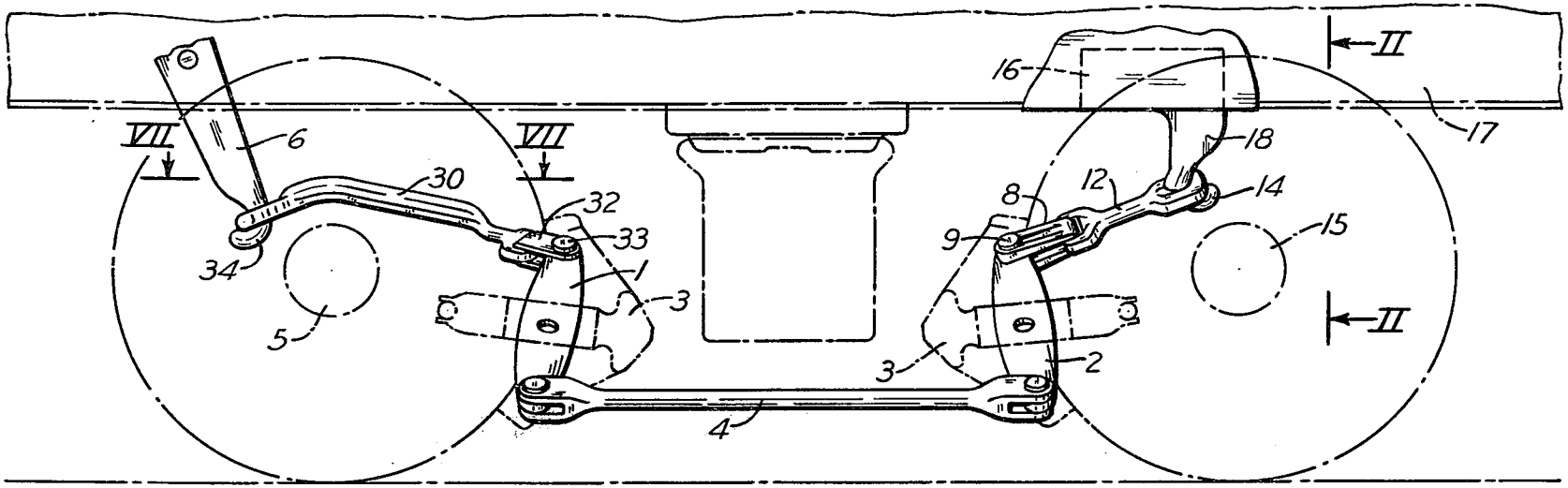
FIG. 1 is a side view of brake rigging.

Referring to FIG. 1 of the drawings, the usual live and dead brake beam levers 1 and 2 have their central portions pivotally supported by conventional brake beams 3, shown in dotted lines, that are supported in the usual manner (not shown) from the side frames of the car truck. The lower ends of the levers are connected by a bottom rod 4 located beneath the truck bolster. This rod is pivotally connected in the usual way to the two levers, which are inclined laterally of the railway car at an angle, usually about 40° to the horizontal. The upper end of the live lever 1 is pivotally connected to means to be described later extending across the adjacent axle 5 to the lower end of the actuating or fulcrum lever 6 for pulling on the upper end of the live lever to apply the brakes. In order for the brakes to be applied, however, the upper end of the dead lever 2 must be anchored to the car. The means by which this is done form part of this invention.

Figure 2:
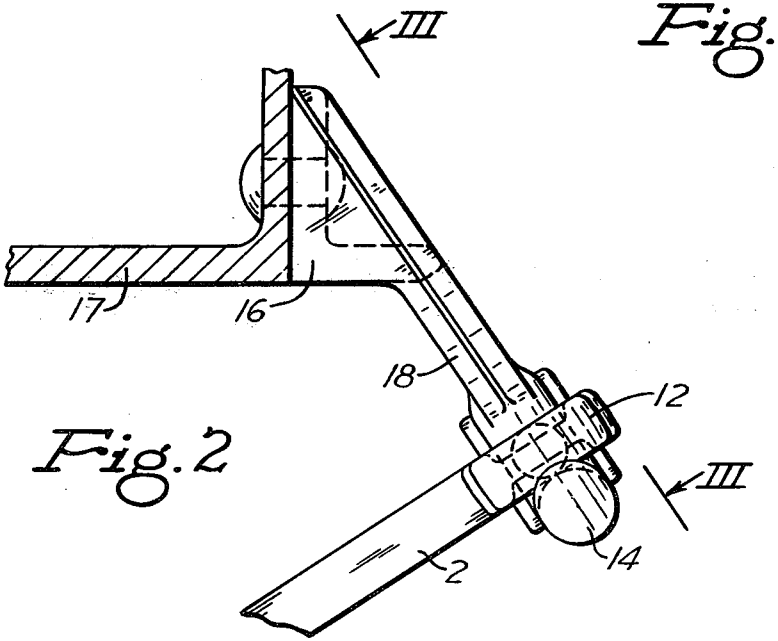
FIg. 2 is an enlarged fragmentary end view taken on the line II—II of FIG. 1.
Figure 3:
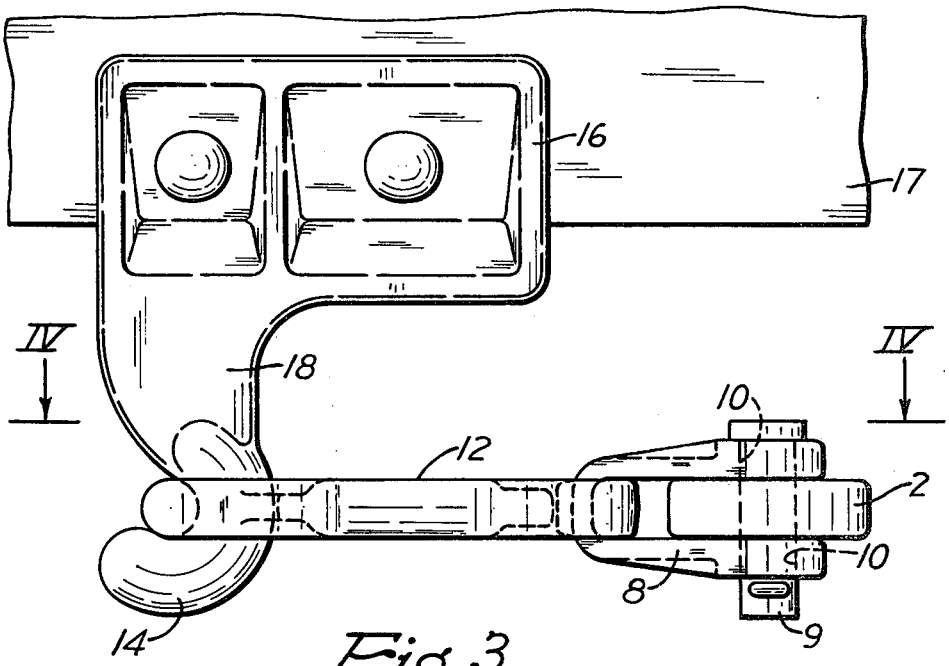
FIG. 3 is a side view taken in an inclined plane on the line III—III of FIG. 2.
Figure 4:
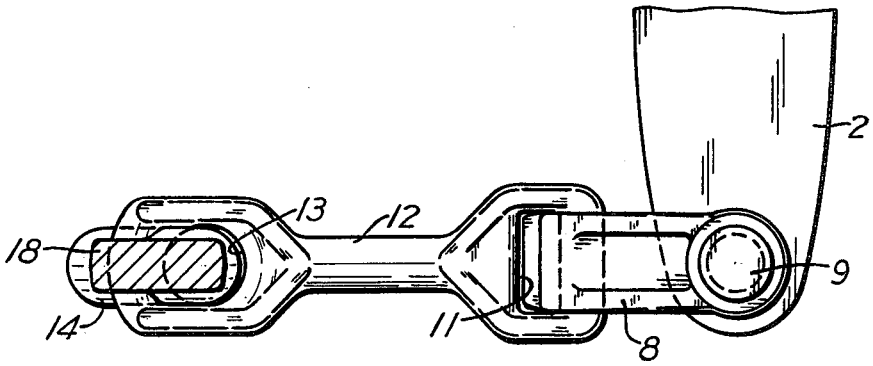
FIG. 4 is a view taken on the line IV—IV of FIG. 3.

Thus, it is a feature of this invention that a clevis 8 is pivotally connected to the upper end of the dead lever 2 by means of a pivot pin 9 that extends through the lever and through aligned openings 10 (FIG. 3) in the parallel sides of the clevis that straddle the lever. As shown in FIGS. 3 and 4, the curved closed end of the clevis extends through an opening 11 in one end of a straight connecting link 12 formed from a forged metal rigid bar that has enlarged flattened ends integrally connected by a round rod. The opposite end of the link also is provided with an opening 13, which receives a hook 14 at the lower end of an anchor member. The link is short enough to permit this anchor member to be located in such position that at least part of the hook will be between the dead lever and the adjacent axle 15 when the car is loaded and its springs compressed. The body portion 16 of the anchor member has a flat vertical side that engages the side of the center sill 17 of the car body opposite to bottom rod 4. The anchor member is attached to the sill by bolts, rivets or welding. The anchor member has a leg 18 that slopes downwardly away from the sill at right angles to the inclined dead lever, as shown in FIG. 2, and the hook 14 is at the lower end of this leg. The height of the hook is such that link 12 can extend substantially horizontally from it to clevis 8 when the car is loaded.

The connection between hook 14 and the link 12 is a hook and eye connection, in which opening 13 through the link forms the center of the eye. The hook and the portion of the link that encircles opening 13 are circular in cross section. The diameter of the hook in cross section is nearly as great as the inside of the eye, and the hook has an inside radius substantially the same as the radius of the section of the eye seated in the hook, as shown in FIG. 3. The hook forms an arc of a circle and exends far enough around the bottom of the eye to keep them from separating accidentally. In other words, there is no possibility of the link dropping away from the anchor member as long as the link is connected with the dead lever.

Since clevis 8 extends through the other or second opening 11 in the link, it will be seen that the clevis can be swung sideways relative to the link if necessary. However, it is highly desirable that it not be possible for the clevis to swing relative to the link in a plane that is perpendicular to the axis of the clevis openings 10. To prevent that from happening, the shape of the portion of the clevis that extends through the link and the shape of opening 11 through which the clevis extends are such that the link will restrain the clevis from the undesired movement. Preferably, the opening in the link is rectangular as shown in FIG. 4, and the portion of the clevis in the opening has the same general shape in cross section and fits in the opening with very little clearance. Also, the longitudinal axis of the opening is perpendicular to the longitudinal axis of the link, so the clevis is formed from a forged bar that is wider than it is thick and fits in opening 11. The closed end portion of the clevis extending through the link is U-shape, as shown in FIG. 3, with its inner surface curved and engaging the curved outer side wall of the rectangular opening.

With the construction just described, the link can be quickly connected to the anchor member and then the clevis can be pinned to the upper end of the dead lever. The flexible connections between the link and the clevis and between the link and the anchor member facilitate securing the clevis to the dead lever. To prevent the clevis from separating from the link before or during installation, the thickness of the ends of the clevis bar is such that it requires considerable force to pass one of those ends through opening 10. Once the two pieces are connected, they will not separate accidentally.

The linkage just described uses less metal and is lighter in weight than heretofore, which are advantages that reduce the cost.

Figure 6:
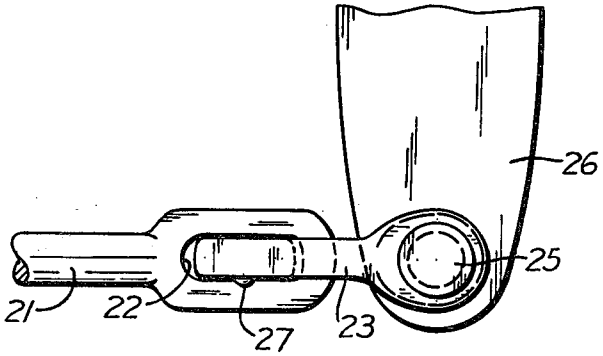
FIG. 6 is a fragmentary view, similar to FIG. 4, of the modification.
Figure 5:
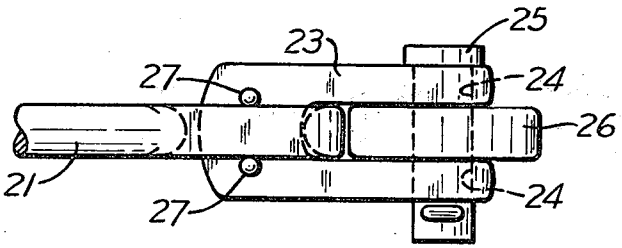
FIG. 5 is a fragmentary view, similar to FIG. 3, of a modification.

In the modification shown in FIGS. 5 and 6, the left-hand end of the link 21 is the same as that of link 12 shown in FIGS. 3 and 4. However, the right-hand end is different because the rectangular opening 22 through the link has its longitudinal axis extending lengthwise of the link instead of crosswise. The clevis 23 that fits in this opening has two round legs with enlarged outer ends in which there are aligned openings 24 that receive the pivot pin 25 which connects the clevis to a brake lever 26. The inner ends of the legs are integrally connected with a flattened body portion that fits in the opening in the link. The clevis is forged with its flattened outer ends in the same plane as the body of the clevis, after which they are twisted 90° parallel relation. In order to prevent the clevis from becoming disconnected from the link before it is connected to a brake lever, the body of the clevis at opposite sides of the opening in the link is provided with a pair of small projections or detents 27. The combined thickness of each detent and the clevis body is slightly greater than the thickness of opening 22 so that considerable force has to be exerted against the clevis to move its body into centered position in the link opening. The opposite sides of the opening may be sprung apart slightly during this operation, but once the clevis is in place it cannot accidentally separate from the link.

Figure 7:
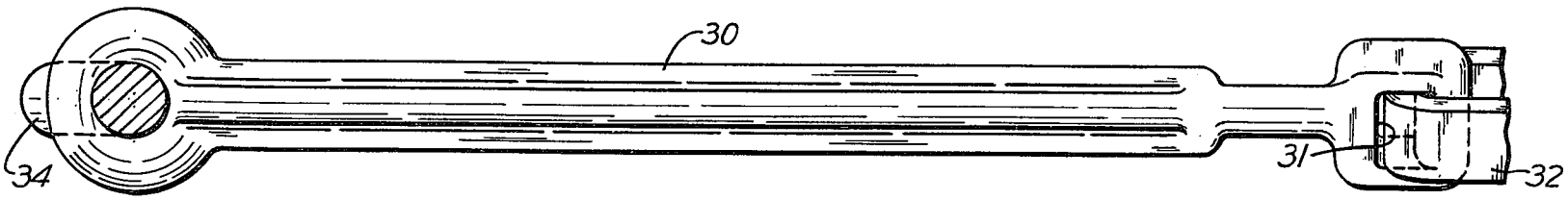
FIg. 7 is an enlarged view taken on the line VII—VII of FIG. 1.

The means by which the upper end of the live lever 1 is connected to actuating lever 6 will now be described by reference to FIGS. 1 and 7. It is the same type of linkage that connects dead lever 2 to anchor member 18, but the link is much longer because it has to extend across axle 5. At its inner end this link 30 is provided with a transverse rectangular opening 31, in which is mounted a clevis 32 that straddles the upper end of the live lever. A pivot pin 33 connects the clevis to the lever. The opposite end of the link is enlarged and provided with a circular opening, through which extends a hook 34 forming the lower end of lever 6. This hook and eye connection is like the connection between link 12 and anchor member 18. When the car is loaded, so that its body is depressed, the link extends substantially horizontally across the axle. Since lever 6 is vertical and lever 1 is inclined, the inner or right-hand end of the link is twisted on its longitudinal axis so that it will lie in substantially the same inclined plane as brake lever 1.

According to the provisions of the patent statutes, I have explained the principle of my invention and have illustrated and described what I now consider to represent its best embodiment. However, I desire to have it understood that, within the scope of the appended claims, the invention may be practiced otherwise than as specifically illustrated and described.

I claim:

1. Brake rigging linkage for connection to an upper end of a railway car brake beam lever, comprising an elongated link provided at one end with an opening for receiving a member supported by a railway car body, the opposite end of the link being provided with a rectangular slot therethrough with its longer dimension extending lengthwise of the link, and a clevis extending through said slot and having parallel free ends provided with aligned openings therethrough for connecting it to the upper end of a brake beam lever, the portion of the clevis in said slot substantially filling it so that the clevis is restrained by the link from swinging relative to the link in a plane perpendicular to the axis of said clevis openings, the clevis being provided beside said rectangular slot with detents adjacent the link, the combined thickness of the detents and the adjoining portion of the clevis being slightly greater than the depth of said rectangular slot to prevent accidental separation of the clevis from the link before installation in brake rigging.

2. The combination with a railway car body supported by a truck provided with wheels mounted on parallel axles, of a pair of brake beams between the axles movable toward and away from each other, two inclined brake levers pivotally connected to said beams and having upper and lower ends, a connecting rod pivotally connected to the lower ends of said levers, a supporting member suspended from the car body, an elongated link provided at one end with a circular opening, said supporting member being provided with a hook circular in cross section and extending through said circular opening to support the link, the opposite end of the link being provided with a slot therethrough elongated in one direction, a clevis having a closed end extending through said slot and having parallel free ends provided with aligned openings therethrough, a pivot pin extending through said aligned openings and the upper end of one of said levers for connecting them, the closed end of the clevis in said slot substantially filling it so that the clevis is restrained by the link from swinging relative to the link in a plane perpendicular to the axis of said pivot pin, and means pivotally connected to the upper end of the other of said levers for controlling the position of the upper end of that other lever.

3. The combination recited in claim 2, in which said supporting member is a fulcrum lever pivotally connected to the car body, said link extends substantially horizontally across one of said axles, and the end portion of said link adjacent said fulcrum lever is inclined downwardly from above the underlying axle toward said hook.

4. The combination with a railway car body supported by a truck provided with wheels mounted on parallel axles, of a pair of brake beams between the axles movable toward and away from each other, two inclined brake levers pivotally connected to said beams and having upper and lower ends, a connecting rod pivotally connected to the lower ends of said levers, a supporting member suspended from the car body, an elongated link provided at one end with an opening for receiving said member to support the link, the opposite end of the link being provided with a slot therethrough elongated in one direction, a clevis having a closed end extending through said slot and having parallel free ends provided with aligned openings therethrough, a pivot pin extending through said aligned openings and the upper end of one of said levers for connecting them, the closed end of the clevis in said slot substantially filling it so that the clevis is restrained by the link from swinging relative to the link in a plane perpendicular to the axis of said pivot pin, and means pivotally connected to the upper end of the other of said levers for controlling the position of the upper end of that other lever.

* * * * *